United States Patent [19]

Cotton

[11] 4,421,449

[45] Dec. 20, 1983

[54] VEHICLE LIFT ATTACHMENT

[76] Inventor: Vernon Cotton, Pond St., Groveland, Mass. 01834

[21] Appl. No.: 315,511

[22] Filed: Oct. 27, 1981

[51] Int. Cl.[3] ..... E01H 5/06; B66F 9/00

[52] U.S. Cl. ..... 414/685; 187/9 R; 37/117.5; 37/241

[58] Field of Search ..... 187/9 E, 9 R, 95; 414/723, 724, 680, 685, 686, 630; 254/124, 8 R; 37/117.5, 241, DIG. 3, DIG. 12

[56] References Cited

U.S. PATENT DOCUMENTS

| | | | |
|---|---|---|---|
| 2,593,796 | 4/1952 | Riewerts | 414/724 |
| 2,653,678 | 9/1953 | Lehrman | 187/9 R |
| 3,272,287 | 9/1966 | Easton | 187/9 E |
| 3,826,392 | 6/1974 | Farley | 414/630 |
| 4,222,186 | 9/1980 | Molby | 37/117.5 |
| 4,273,500 | 6/1981 | Yates | 187/9 E X |

*Primary Examiner*—Robert B. Reeves
*Assistant Examiner*—Russell D. Stormer
*Attorney, Agent, or Firm*—Cesari and McKenna

[57] ABSTRACT

A forklift attachment for a vehicle includes a cross frame member which is arranged to be pivotally connected to the frame members of a conventional snowplow blade lift mounted to the front of the vehicle. The cross frame member can be raised and lowered by the lift's hydraulic piston. A plurality of tines are slidably mounted to the cross frame member so that they project forwardly of that member and are in position to engage under a load when the cross frame member is in a lower position adjacent the ground and then lift the load above the ground when the cross frame member is raised by the piston.

4 Claims, 3 Drawing Figures

VEHICLE LIFT ATTACHMENT

This invention relates to a lifting attachment for the front of a vehicle. It relates more particularly to an attachment in the nature of a forklift.

BACKGROUND OF THE INVENTION

A forklift is a vehicle used to transport a load such as a pallet, boards, logs, etc. from one location to another. The vehicle has forwardly projecting tines which can be raised and lowered relative to the ground. The tines are engaged under the load and raised above the ground. Then the vehicle is driven to the load destination and the load deposited at that location. Usually, the forklift is mounted to the front of a vehicle which is dedicated to that purpose. These vehicles are quite expensive and accordingly, they are used primarily at construction and loading sites where they can be operated continually to justify their high cost.

In many situations around the home or farm it would be highly desirable to have such apparatus in order to move heavy objects from one location to another. For example, when cutting down trees for firewood, it would be desirable to be able to use such a lift to transport the cut logs from the wooded area to a stack closer to the house. Such a lift, in order to be cost effective, would have to attach to a vehicle normally found around the house or farm.

SUMMARY OF THE INVENTION

Accordingly, the present invention aims to provide a forklift attachment for a vehicle of the type often found at the average house or farm.

Another object of the invention is to provide a vehicle forklift attachment which is relatively inexpensive to manufacture.

Yet another object of the invention is to provide such an attachment which is easy to install by the average homeowner.

A further object of the invention is to provide a forklift attachment for a vehicle which can be adjusted to suit different size loads.

Another object of the invention is to provide a forklift of this type with a log-splitting attachment by which cut logs can be split and then transported from a cutting location to a storage location.

Other objects will, in part, be obvious and will, in part, appear hereinafter.

The invention accordingly comprises the features of construction, combination of elements and arrangement of parts which will be exemplified in the following detailed description, and the scope of the invention will be indicated in the claims.

Briefly, my forklift attachment is arranged to be attached to a conventional snowplow lift of the type commonly mounted to the front of a small vehicle such as a pick-up truck or Jeep vehicle. The lift comprises a lateral U-shaped cross-frame member. Projecting from the rear face of that member is a pair of laterally spaced-apart tongues whose ends are pivotally connected to the snowplow lift frames mounted to the vehicle chassis. An eye affixed to the cross member is connected by a chain or cable to the pivoting lifting member of the snowplow lift at the front of the vehicle which member is raised and lowered by the hydraulic piston invariably found on the usual snowplow lift. Thus, by operating the piston, the cross member can be moved between a lower position wherein it essentially rests on the ground and an elevated position wherein it is suspended by the snowplow lift an appreciable distance above the ground.

The lift also includes a plurality of elongated tines. Attached to one end of each tine is an inverted U-shaped bracket which can hook over the cross member so that the tines project forwardly of that member. The engagement of the tines on the cross member is such that the tines can be slid laterally on that member so that the spacing between the tines can be adjusted to suit the lateral span of the particular load which the lift is going to support.

To use the lift, the piston is retracted to move the cross member and tines to their lower position adjacent the ground. The vehicle to which the lift is mounted is then moved forward so that the tines engage under the load, e.g. a pallet. Following this, the piston is extended so that the tines and cross member are raised above the ground a sufficient distance to enable the vehicle to travel to the load destination. At that location, the piston is retracted, thereby lowering the tines and the load which they support to the ground and the vehicle is backed off to disengage the tines from the load.

The upstanding arms of the U-shaped cross frame member are formed as tubes. Also, the cross sectional area of the tines is slightly less than the area of the tubular openings in the arms so that the tines can be stored endwise in those arms when the lift is not being used. Likewise, posts or studs can be positioned in those arms to provide rear supports when the lift is being used to transport an extra high load such as a pile of logs.

Thus, the present forklift attachment comprises only a relatively few simple parts which are relatively easy to make and assemble. Therefore, the attachment is a valuable tool which can be fitted to a conventional snowplow lift mounted to a small vehicle and used to transport various loads around the home or farm.

BRIEF DESCRIPTION OF THE DRAWINGS

For a fuller understanding of the nature and objects of the invention, reference should be had to the following detailed description, taken in connection with the accompanying drawings, in which.

DESCRIPTION OF THE PREFERRED EMBODIMENT

Figure 1:
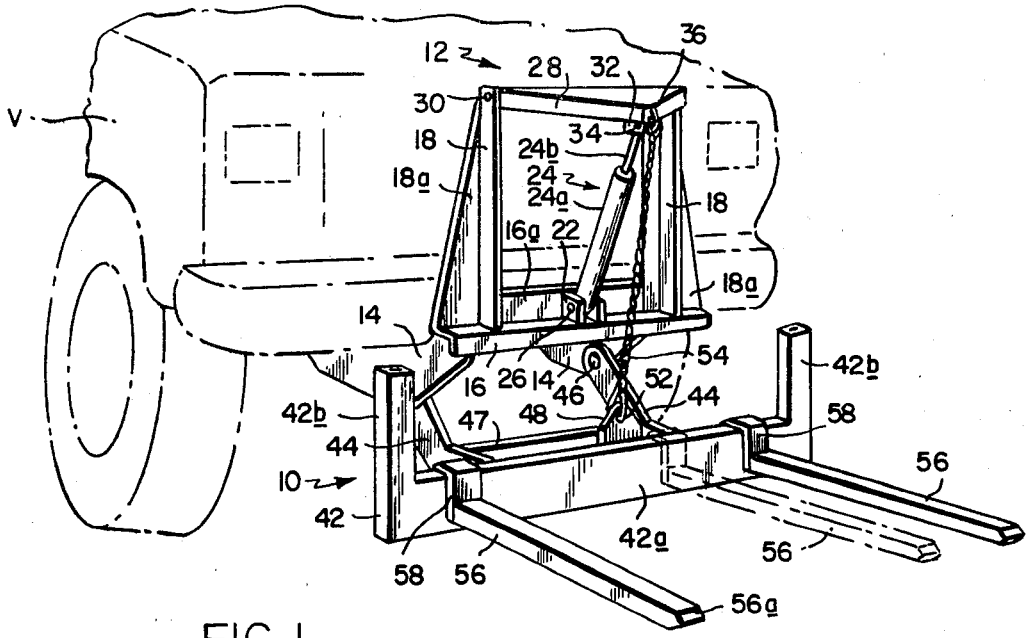
FIG. 1 is an isometric view of a lift attachment mounted to the snowplow lift on the front of a vehicle, the attachment being shown in its lower position.

Turning now to FIG. 1 of the drawings, my improved lift attachment is shown generally at 10. It is attached to a conventional snowplow lift shown generally at 12 which is in turn mounted to the front of a vehicle V such as a small truck or Jeep.

The snowplow lift 12 is of a conventional construction and, therefore, it will not be described in detail. Suffice it to say that the snowplow lift 12 comprises a pair of laterally spaced-apart frame members 14 which are mounted to the chassis of the vehicle V below the body of that vehicle. The free ends of the frame members 14 are connected by a cross frame member 16. A pair of laterally spaced-apart standards 18 project up from cross frame member 16 inboard of its ends. Each standard 18 includes a generally triangular lateral web 18*a* extending from the rear edge of the standard down to the rear edge of the frame member 16 outboard of that standard. Also the frame member 16 includes an upstanding flange 16*a* extending along its rear edge and attached to the rear edges of the standards 18 to rigidify that frame structure.

Figure 2:
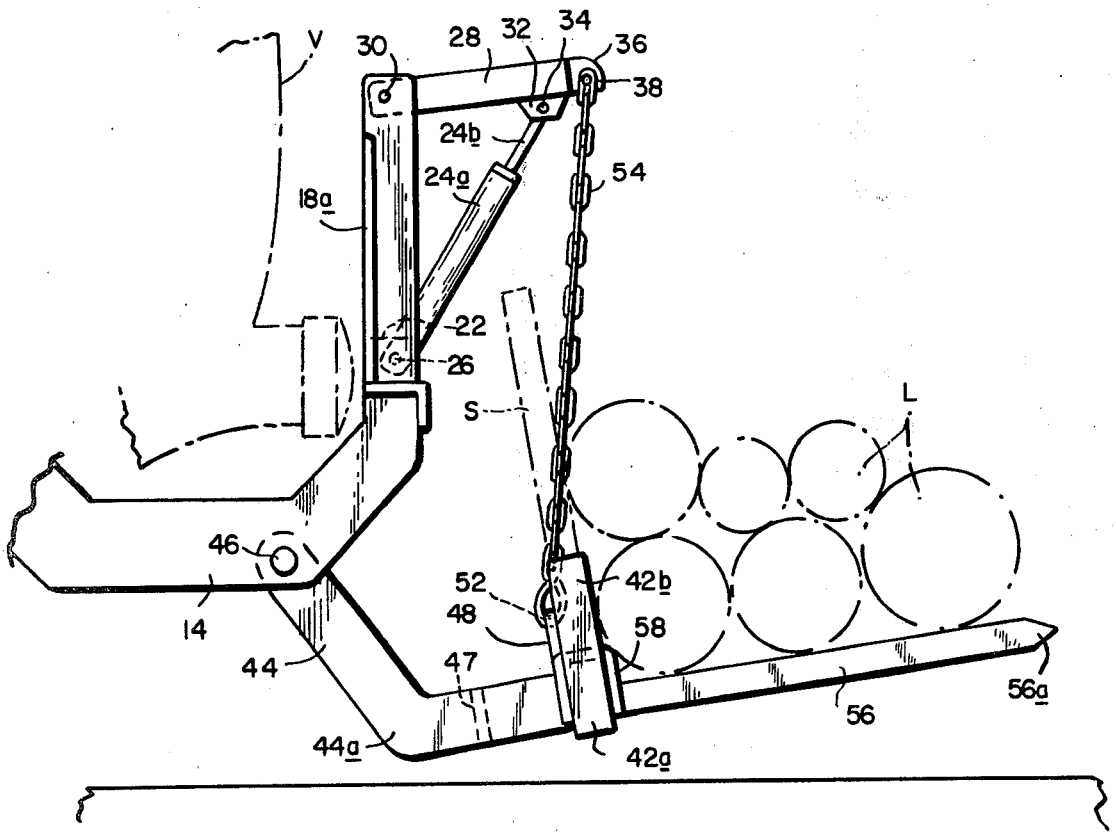
FIG. 2 is a side elevational view of the attachment in a partially raised position.

A pair of laterally spaced-apart ears 22 project forwardly from the frame member flange 16*a*. The lower end of a cylinder 24*a* comprising a piston 24 is positioned between those ears and pivotally connected thereto by a pin or pivot 26. A right-angled lifting frame member 28 is concentrated at its ends to the upper ends of standards 18 by pivots 30. As shown in FIGS. 1 and 2, an ear 32 extends down from the corner of frame member 28 and is attached by a pivot 34 to the rod 24*b* of piston 24. The corner of frame member 28 also has a forwardly projecting ear 36 containing an opening 38. When the lift 12 is used conventionally to support a snowplow blade, the arms of the blade are pivotally connected to the frame members 14 and a chain leading from the blade is connected to the opening 38 of the ear 36. Thus, by extending and retracting the piston rod 24*b*, the lifting frame 28 and thus the snowplow blade can be moved vertically relative to the ground. The snowplow lift 12 also includes the usual hydraulic circuit including a pump (not shown) which operates off the vehicle's engine for providing the fluid pressure for actuating the piston 24.

As best seen in FIGS. 1 and 2, the present attachment 10 comprises a generally U-shaped cross frame member 42. The cross frame member includes a horizontally-oriented, straight, rigid box girder 42*a* having at its opposite ends a pair of upstanding arms 42*b* also formed as box girders. Thus the cross frame member as a whole is extremely stiff and rigid. A pair of laterally spaced-apart rigid tongues 44 are welded or otherwise secured to the rear face of the box girder 42*a*. The rear segments of those tongues are angled upwardly and their ends connected by pivots 46 to the snowplow lift frame members 14. Also, to strengthen the structure, a reinforcing cross member 47 is connected between the tongues just behind girder 42*a*.

An upstanding ear 48 is welded or otherwise anchored to the rear face of the box girder 42*a* midway along its length. Formed in ear 48 is an opening 52 fo attaching one end of a cable or chain 54 whose other end is attached to the eye 38 in the ear 36 of the snowplow lifting member 28.

Still referring to FIGS. 1 and 2, the attachment 10 also includes a plurality of long rigid tines 56. The leading end 56*a* of each tine is tapered to a relatively sharp horizontal edge. Welded or otherwise attached to the rear end of each tine 56 is a rigid strap in the shape of an inverted letter U. Each strap 58 is sized so that it can be slidably engaged over the cross frame member 42 or more particularly its box girder 42*a*. The fit between each strap and the cross frame is such that the tines can be slid along the box girder 42*a* as indicated by the dotted line tine shown in FIG. 1. Thus the spacing between the tines 56 can be adjusted to accommodate the lower horizontal span of the load to be lifted.

The length of the cable 54 is such that, when the piston rod 24*b* is in its fully retracted position, the cross frame member 42 and the tines supported thereby more or less rest on the ground or slightly above the ground in a horizontal plane as seen in FIG. 1. Thus, when the vehicle V is advanced forwardly, the tines 56 can be engaged under a load such as a pallet. Then when the piston rod 24*b* is extended, the frame member 42 and the tines 56 are swung upwardly about the tongue pivots 46 to the frame members 14 so that the tines are upwardly angled as shown in FIG. 2. In this position of the lift attachment, articles such as the logs L shown in dotted lines in FIG. 2 can be dropped crosswise onto the tines.

In this connection, we should mention that the upstanding cross frame member arms 42*b* are formed as box girders not only to strenghten them, but also to enable studs or posts S (FIG. 2) to be inserted into the ends of those arms. The posts thus provide rear supports for a relatively high load carried on the tines as further illustrated by the logs L in FIG. 2. Most desirably, the tubular openings in the arms 42*b* are sized to receive a lengthwise segment of a standard 2×3 building stud. The height of the stud would, of course, depend upon the height of the load being transported by the lift. In any event, when the attachment 10 is in its partially raised position shown in FIG. 2, the components of the attachment are spaced sufficiently above the ground to permit the vehicle V to transport the load to the desired destination.

Typically, the maximum angle through which the cross member 42 and tines 56 can be swung is one which raises the elbow 44*a* of the tongues 44 approximately two (2) feet off the ground, that distance depending to a great extent on the size of the vehicle V. In any event, in its fully raised position illustrated in FIG. 3, the cross member and tines are oriented at an appreciable angle relative to the ground. Consequently, they can support stably relatively large and heavy objects as the vehicle V travels to its destination.

Figure 3:
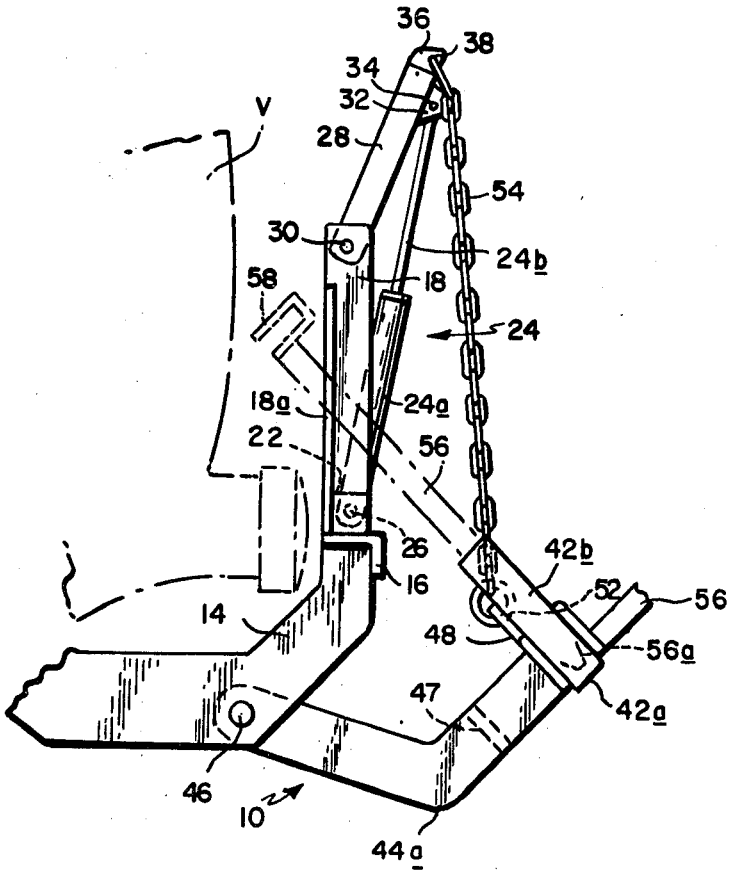
FIG. 3 is a similar view showing the attachment in its fully raised position.

We should mention also that, when the lift attachment is not being used, it is elevated to its maximum height illustrated in FIG. 3. The cross sectional dimensions of the tines 56 are substantially the same as the studs S illustrated in FIG. 2. Accordingly, they can be removed from the cross frame member 42 and inserted pointed-end-first into the upstanding arms 42*b* one such stored tine being illustrated in dotted lines in FIG. 3. This permits the vehicle V to be used for its normal duties.

As seen from the foregoing, then, the present lift attachment 10 is constructed of a very few simple welded parts. Furthermore, it can be installed easily on a standard snowplow lift commonly found on many vehicles, thereby enabling the farmer and homeowner to achieve all of the benefits of the much more expensive forklift trucks. Yet the installation of the present attachment does not in any way adversely affect or impede the ability of the vehicle to perform its normal chores.

It will thus be seen that the objects set forth above, among those made apparent from the preceding description, are efficiently attained, and, since certain changes may be made in the above constructions without departing from the scope of the invention, it is intended that all matter contained in the above description or shown in the accompanying drawings be interpreted as illustrative and not in a limiting sense.

It is also to be understood that the following claims are intended to cover all of the generic and specific features of the invention herein described.

What is claimed as new and desired to be secured by Letters Patent of the United States is:

1. A lift attachment for a vehicle comprising

A. a snow plow lift mounted to the front of the vehicle;

B. a rigid cross frame member;

C. a pair of tongues, said tongues having (1) one end attached to the cross frame member at laterally spaced-apart locations thereon, and (2) an opposite end arranged to be pivotally connected to the vehicle chassis;

D. a plurality of tines, said tines each having one end provided with a bracket to enable the tine to be engaged on the cross frame member so the tine projects forwardly of that member, and E. means connected between the cross frame member and the snowplow lift enabling the lift to swing the cross frame member from a lower position adjacent the ground to an elevated position above the ground.

2. The lift attachment defined in claim 1 wherein the bracket is slidably engaged over the cross frame member so that the tines can be slid laterally on that member to adjust the spacing between them.

3. The lift attachment defined in claim 1 and further including a pair of upstanding tubular arms attached to the opposite ends of the cross frame member.

4. The lift attachment defined in claim 3 wherein the tubular arms each contain a passage and the tines have dimensions which enable the tines to be received endwise and stored in the said passages.

* * * * *